US005738081A

United States Patent [19]

Puricelli

[11] Patent Number: 5,738,081

[45] Date of Patent: Apr. 14, 1998

[54] SELF-CLEANING DOUBLE OVEN

[75] Inventor: Orio Puricelli, Gallarate, Italy

[73] Assignee: Fulgor S.P.A., Gallarate, Italy

[21] Appl. No.: 656,521

[22] Filed: May 31, 1996

[51] Int. Cl.[6] ..... A21B 1/00

[52] U.S. Cl. ..... 126/21 A; 126/273 R; 219/400; 219/394

[58] Field of Search ..... 219/400, 395, 219/396, 408, 394, 393, 397; 126/21 A, 273 R

[56] References Cited

U.S. PATENT DOCUMENTS 4,354,084 10/1982 Husslein ..... 126/21 A 4,763,638 8/1988 Hurley et al. ..... 126/21 A 5,387,258 2/1995 Puricelli ..... 219/400

*Primary Examiner*—Carroll B. Dority

*Attorney, Agent, or Firm*—R. Neil Sudol; Henry D. Coleman

[57] ABSTRACT

A self-cleaning oven with improved venting system includes a bottom oven portion, a top oven portion, a back wall and a front member; the top oven portion and the bottom oven portion are separated by an inclined screen wall which is associated with the back wall and with the front member.

11 Claims, 2 Drawing Sheets

61
65
66
161
165
166
71
70
7
9
51
69
77
103
19
3
17
76
61
11
63
127
131
129
135
133
125
153
105
139
74
75
81
72
15
13
68
21
55
45
25
5
53
33
35
29
27
31
23

SELF-CLEANING DOUBLE OVEN

BACKGROUND OF THE INVENTION

1. Field of the invention

The present invention relates to a self-cleaning double oven with an improved venting system.

2. Description of the Prior Art

A main problem in the construction of double ovens is to insulate one cooking compartment from the other. Generally, the cooking compartments are arranged one on top of the other and it is necessary that the operation of one oven does not interfere with the operation of the other oven which may be working at a considerable different temperature.

A further problem of self-cleaning ovens is to keep the outer surfaces of the oven at a sufficiently low temperature even when the oven operates at its maximum temperature, for example during the self-cleaning operation.

The principal object of the present invention is to provide an improved venting system for household double ovens.

Another aim of the present invention is to provide a double oven having compact dimensions compared to conventional double ovens of similar capacity.

A further object of the invention is to provide a double oven which can be easily included in the kitchen furniture.

SUMMARY OF THE INVENTION

This aim, these objects and others which will become apparent hereinafter are achieved by an oven as claimed in the accompanying claims.

Further characteristics and advantages of the invention will become apparent from a reading of the detailed description of a preferred but not exclusive embodiment of an oven according to the invention, illustrated only by way of a non-limiting example in the accompanying drawings.

DESCRIPTION OF THE PREFERRED EMBODIMENTS OF THE INVENTION

Figure 1:
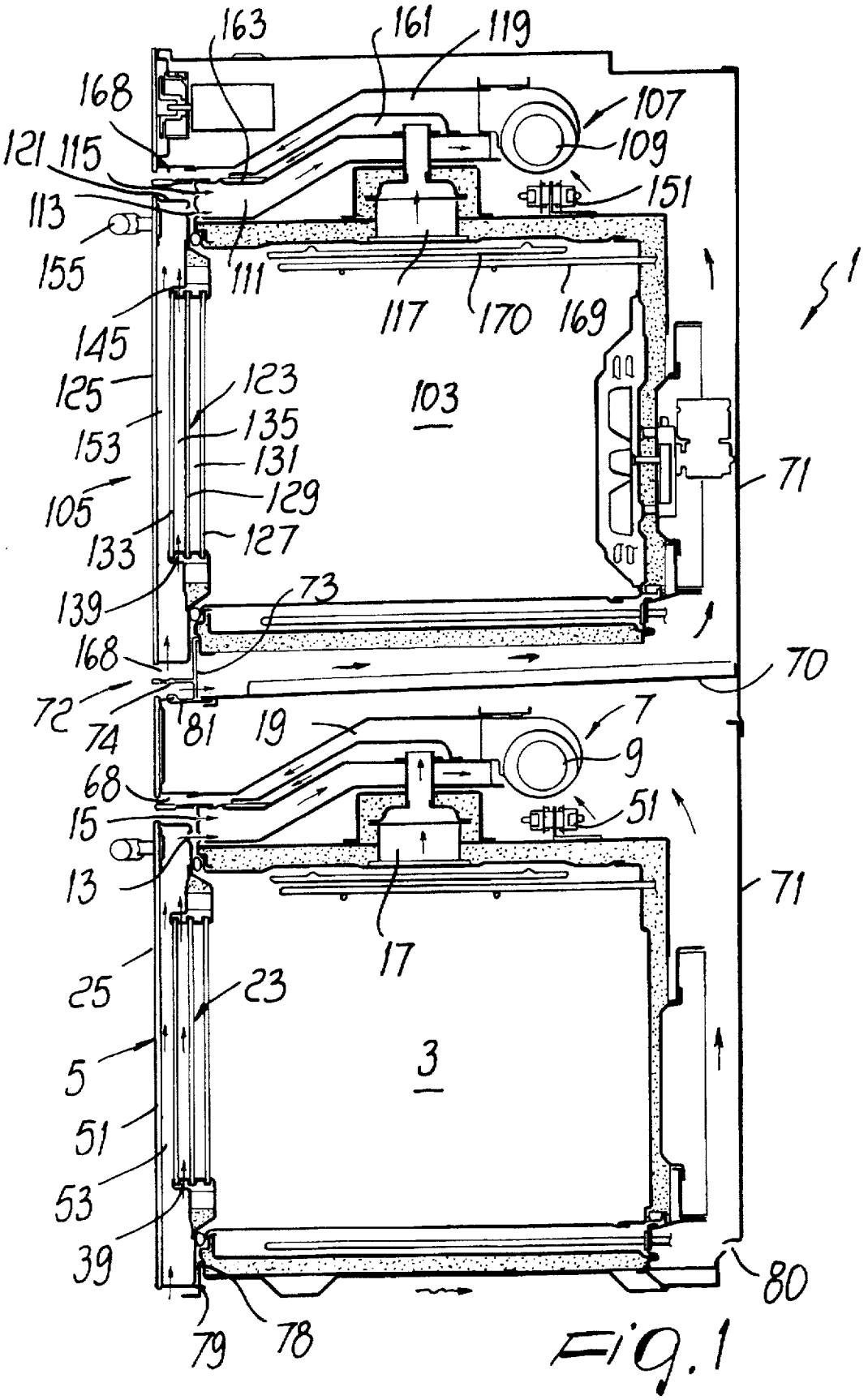
FIG. 1 is a side sectional view, taken along a median plane, of a double oven according to the invention.

With reference to the above figures, a household double oven, of the pyrolytic type, generally designated by the reference numeral 1, has structure comprising a bottom oven portion and a top oven portion. Bottom oven portion has a bottom cooking compartment 3 and a bottom hinged door 5. Top oven portion has a top cooking compartment 103 and a top hinged door 105.

A bottom venting assembly 7 comprises a bottom fan 9, connected to the upper part of bottom door 5 by means of a bottom aspiration duct 11. Bottom fan 9 is also connected to a bottom venting duct 19 for discharging the hot air.

Bottom duct 11 has a first series of lower openings 13 and a second series of upper openings 15 which are formed on the front edge of the oven at bottom door 5 and are connected thereto as described hereinafter.

A safety thermostat 51 is provided proximate to fan 9 and is adapted to turn off the oven in case the temperature rises over a preset limit, for example in case fan 9 accidentally ceases to operate.

A bottom venting device for expelling the combustion residues generated during the self-cleaning operation of the oven, comprises a bottom catalytic element 17 through which the residues pass before they are expelled from the cooking compartment by means of bottom auxiliary venting duct 61.

Figures 2, 3, 4:
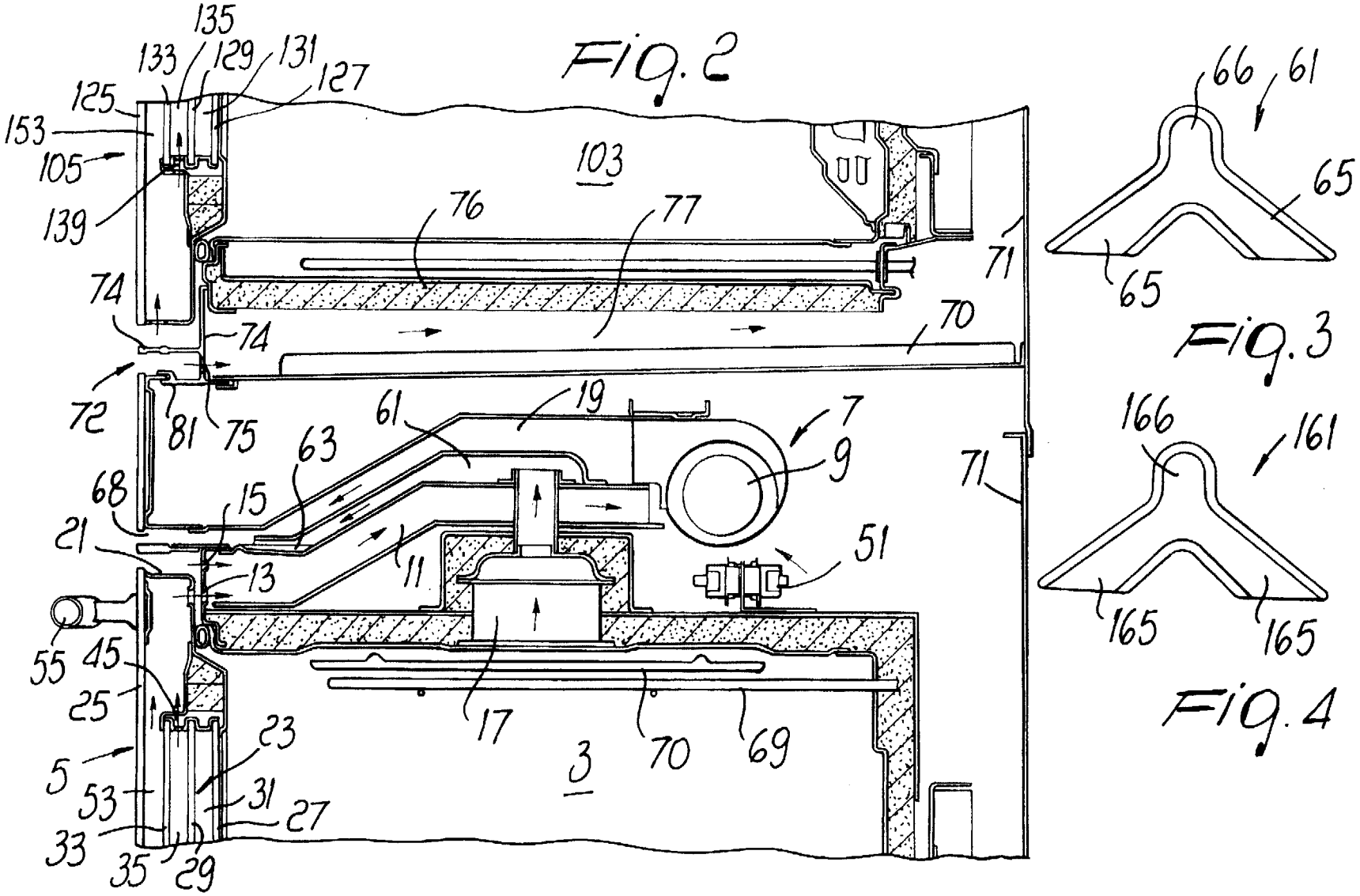
FIG. 2 is an enlarged side sectional partial view of the double oven, taken along a median plane.
FIG. 3 is a top view of the bottom auxiliary venting duct.
FIG. 4 is a top view of the top auxiliary venting duct.

As better illustrated in FIG. 2, a heat reflector 70 is provided at the upper portion of the bottom cooking compartment, between the venting device and a bottom heating member 69, in order to improve insulation between the cooking compartment and the venting system.

Bottom auxiliary venting duct 61 is substantially V shaped and is arranged inside bottom venting duct 19. Bottom auxiliary venting duct 61 has a manifold 66, arranged at the venting device, and branches 65.

At each of the ends of branches 65, a bottom tray or cup 63 is formed in the base of bottom venting duct 19. Since the air flowing in bottom aspiration duct 11 is at a considerably lower temperature than the air flowing in bottom auxiliary duct 61, the moisture, possibly present in the air discharged through the auxiliary venting duct, condenses on the lower surface of bottom auxiliary duct 61 and is collected in bottom trays 63.

The hot air is discharged from bottom opening, or outlet, 68, arranged above bottom handle 55 of the hinged door; however, because of the V-shaped construction of bottom auxiliary venting duct 61, the air is discharged mostly at the sides. In this manner the center portion of the door handle, where the user would place his/her hand for opening the door, remains at a lower temperature.

The bottom door 5 comprises a frame 21 which is centrally open and is adapted to support a first series of internal panels 23 and an external panel 25. As customary in household ovens, the panels are made of transparent material in order to allow visual inspection of the cooking compartment without having to open the door.

The series of internal panels comprises, starting from the side directed toward compartment 3: a first panel 27 and a second panel 29, separated by a first interspace 31, and a third panel 33 separated from the second panel by a second interspace 35.

The panels 27, 29 and 33 are fixed to one another and to frame 21 by means of upper and lower fastening members. The fastening members have lower openings 39 and upper openings 45 adapted to connect interspace 35 to the outside. First interspace 31 is instead isolated.

The fastening members are preferably constituted by metal sections and have a heat-reflecting surface directed toward compartment 3 so as to constitute a screen which reflects the heat inward.

Bottom door 5 has a fourth panel 51 which is fixed to the outside of the frame 21 so as to define a third interspace 53 with third panel 33. Third interspace 53 is connected to the outside in a downward position by means of openings (not shown) formed along the lower edge of the frame. In an upward position, the third interspace is connected both to the outside, at handle 55, and to bottom openings 13 of bottom aspiration duct 11.

A reflecting foil frame is preferably provided on the inner surface of fourth panel 51. The foil frame is made of aluminum or any other suitable material adapted to reflect heat.

Top compartment 103 comprises a top venting assembly 107 having a top fan 109, connected to the upper part of top door 105 by means of a top aspiration duct 111. Top fan 109 is also connected to a top venting duct 119 for discharging the hot air.

Top duct 111 has a first series of lower openings 113 and a second series of upper openings 115 which are formed on the front edge of the oven at top door 105 and are connected thereto as described hereinafter.

A safety thermostat 151 is provided proximate to fan 109 and is adapted to turn off the oven in case the temperature rises over a preset limit, for example in case fan 109 accidentally ceases to operate.

A top venting device for expelling the combustion residues generated during the self-cleaning operation of the oven, comprises a top catalytic element 117 through which the residues pass before they are expelled from the cooking compartment by means of top auxiliary venting duct 161.

A heat reflector 170 is provided at the upper portion of the top cooking compartment, between the venting device and a top heating member 169, in order to improve insulation between the cooking compartment and the venting system.

Top auxiliary venting duct 161 is substantially V shaped and is arranged inside top venting duct 119. Top auxiliary venting duct 161 has a manifold 166, arranged at the venting device, and branches 165.

At each of the ends of the branches 165, a top tray or cup 163 is formed in the base of the top venting duct 119. Since the air flowing in the top aspiration duct 111 is at a considerably lower temperature than the air flowing in the top auxiliary duct 161, the moisture, possibly present in the air discharged through the auxiliary venting duct, condenses on the lower surface of the top auxiliary duct 161 and is collected in the top trays 163.

The hot air is discharged from the top opening, or outlet, 168, arranged above the top handle 155 of the hinged door, however, because of the V-shaped construction of the top auxiliary venting duct 161, the air is discharged mostly at the sides. In this manner the center portion of the door handle, where generally the user places his/her hand for opening the door, remains at a lower temperature.

Top door 105 comprises a frame 121 which is centrally open and is adapted to support a first series of internal panels 123 and an external panel 125. As customary in household ovens, the panels are made of transparent material in order to allow visual inspection of the cooking compartment without having to open the door.

The series of internal panels comprises, starting from the side directed toward the compartment 103: a first panel 127 and a second panel 129, separated by a first interspace 131, and a third panel 133 separated from the second panel by a second interspace 135.

Panels 127, 129 and 133 are fixed to one another and to frame 121 by means of upper and lower fastening members. The fastening members have lower openings 139 and upper openings 145 adapted to connect interspace 135 to the outside. First interspace 131 is instead isolated.

The fastening members are preferably constituted by metal sections and have a heat-reflecting surface directed toward compartment 103 so as to constitute a screen which reflects the heat inward.

Top door 105 has fourth panel 125 fixed to the outside of frame 121 so as to define a third interspace 153 with third panel 133. Third interspace 153 is connected to the outside in a downward position by means of openings (not shown) formed along the lower edge of the frame. In an upward position, the third interspace is connected both to the outside, at handle 155, and to top openings 113 of top aspiration duct 111.

A reflecting foil frame is preferably provided on the inner surface of fourth panel 125. The foil frame is made of aluminum or any other suitable material adapted to reflect heat.

The top oven portion is separated from the bottom oven portion by a screen wall 70 which is inclined and associated with a back wall 71 and with a front member 72 forming part of the double oven structure.

Front member 72 has a vertical portion 73 and a baffle 74. An opening 75 is provided at vertical portion 73, below baffle 74.

Screen wall 70 and a lower wall 76, of cooking compartment 103, together define a channel 77 communicating with ambient air through opening 75. Opening 75 and channel 77 allow ambient air to reach fan 109 through the back of cooking compartment 103.

Front member 72 also has a partition 81 which prevents ambient air from reaching bottom fan 9 directly through the front member.

In the bottom oven portion, a bottom front member 78 is provided with an opening 79 adapted to allow ambient air to reach bottom fan 9 through the lower and back sides of bottom cooking compartment 3. To this purpose, a further opening 80 is provided at back wall 71.

Should fresh ambient air reach bottom fan 9 directly through front member 72, instead of through the lower and back sides of bottom cooking compartment 3, thermostat 51 will have a slower response to an accidental sudden rise in temperature in the oven if fan 9 ceases to operate, for example. Fresh air would in fact cool thermostat 51 while the temperature in the oven is rising sharply because fan 9 is not operating.

The operation of the oven according to the invention is substantially similar in both top and bottom oven portions. The fans generate a negative pressure in ducts 11, 111 and thus in the third interspaces; outside air therefore enters both from the lower sides of the doors and through the handles, generating a current through the second and third interspaces.

The outward air flow generated by the fans in ducts 19, 119 also draws air from auxiliary ducts 61, 161 and the hot air coming from inside the oven compartment is discharged at the sides of outlets 68, 168.

In this manner, the outer surface of the external panels and of the handles are always at a sufficiently low temperature.

Screen wall 70 effectively isolates the top oven portion from the bottom oven portion. In fact, front member 72 allows ambient air to enter the lower portion of the top oven portion and at the same time prevents fresh ambient air from entering the upper portion of the bottom oven portion, and more particularly from hitting the area of fan 9 and safety thermostat 51.

It has been observed in practice that the invention achieves the intended aim and objects, providing a double oven having a compact size and wherein the two oven portions operate independently and are effectively thermally insulated.

Having thus described one particular embodiment of the invention, various alterations, modifications, and improvements will readily occur to those skilled in the art. Such alterations, modifications, and improvements as are made obvious by this disclosure are intended to be part of this disclosure though not expressly stated herein, and are intended to be within the spirit and scope of the invention.

Accordingly, the foregoing description is by way of example only and is not intended as limiting. The invention is limited only as defined in the following claims and the equivalents thereto.

What I claim is:

1. A self-cleaning double oven with improved venting system comprising a bottom oven portion, a top oven portion, a back wall and a front member, said top oven portion and said bottom oven portion being separated by an inclined screen wall, said inclined screen wall being associated with said back wall and with said front member, said top oven portion comprising a top cooking compartment and a top venting assembly including a top fan, said bottom oven portion comprising a bottom cooking compartment and a bottom venting assembly including a bottom fan, said front member having a partition adapted to prevent ambient air from reaching said bottom fan directly through said front member, said bottom oven portion comprising a bottom front member having an opening adapted to allow ambient air to reach said bottom fan through lower and back sides of said bottom cooking compartment, a further opening being provided at said back wall.

2. The oven according to claim 1 wherein said front member has a vertical portion and a baffle, said vertical portion having an opening provided below said baffle.

3. The oven according to claim 2 wherein said top cooking compartment comprises a lower wall, said screen wall and said lower wall together defining a channel communicating with ambient air through the opening in said vertical portion.

4. The oven according to claim 3 wherein said channel communicates with said top fan along a rear side of said top cooking compartment.

5. A self-cleaning double oven with improved venting system comprising:

a top oven portion having a top cooking compartment, a top thermostat and a top venting assembly including a top fan for drawing ambient air along a top air flow path, said top air flow path extending along a bottom side and a back side of said top cooking compartment and then past said top thermostat and to ambient atmosphere along a top side of said top cooking compartment;

a bottom oven portion having a bottom cooking compartment, a bottom thermostat and a bottom venting assembly including a bottom fan for drawing ambient air along a bottom air flow path, said bottom air flow path extending along a bottom side and a back side of said bottom cooking compartment and then past said bottom thermostat and to ambient atmosphere along a top side of said bottom cooking compartment:

a screen wall separating said top oven portion from said bottom oven portion and extending between said top flow path along the bottom side of said top cooking compartment and said bottom flow path along the top side of said bottom cooking compartment, thereby effectively thermally isolating said bottom thermostat from ambient temperatures and from said top cooking compartment; and said bottom oven portion having a duct for exhausting gases from said bottom cooking compartment, said duct extending only below said screen wall, thereby effectively thermally isolating said top thermostat from exhaust gases from said bottom cooking compartment.

6. The oven according to claim 5, further comprising a back wall and front member, said screen wall being coupled to said back wall and said front member.

7. The oven according to claim 6 wherein said front member has a partition adapted to prevent ambient air from reaching said bottom fan directly through said front member.

8. The oven according to claim 7 wherein said front member additionally has a vertical portion and a baffle, said vertical portion having an opening provided below said baffle.

9. The oven according to claim 8 wherein said top cooking compartment has a bottom wall, said screen wall and said bottom wall together defining a channel communicating with ambient air through the opening in said vertical portion, said channel defining a part of said top flow path.

10. The oven according to claim 5 wherein said channel communicates with said top fan along a rear side of said top cooking compartment.

11. The oven according to claim 5 wherein said bottom oven portion has a bottom front member having an opening adapted to allow ambient air to reach said bottom fan through said bottom flow path, a further opening being provided at a back wall.

* * * * *